US007017280B2

(12) United States Patent
Green et al.

(10) Patent No.: US 7,017,280 B2
(45) Date of Patent: Mar. 28, 2006

(54) CLOTHES DRYER APPARATUS AND METHOD

(75) Inventors: Jeremy Michael Green, Louisville, KY (US); Douglas Allen Riddle, Louisville, KY (US)

(73) Assignee: General Electric Company, Schenectady, NY (US)

( * ) Notice: Subject to any disclaimer, the term of this patent is extended or adjusted under 35 U.S.C. 154(b) by 32 days.

(21) Appl. No.: 10/608,617

(22) Filed: Jun. 27, 2003

(65) Prior Publication Data

US 2004/0261286 A1 Dec. 30, 2004

(51) Int. Cl.
*F26B 3/00* (2006.01)

(52) U.S. Cl. ..... 34/486; 34/553; 34/554; 34/499

(58) Field of Classification Search ..... 34/325, 34/362, 413, 446, 486, 553, 554, 499, 202, 34/318, 549
See application file for complete search history.

(56) References Cited

U.S. PATENT DOCUMENTS

| | | | | |
|---|---|---|---|---|
| 4,086,707 | A | 5/1978 | Bochan | |
| 4,209,915 | A | 7/1980 | Keuleman et al. | |
| 4,226,026 | A | 10/1980 | Deming et al. | |
| 4,231,166 | A * | 11/1980 | McMillan | 34/553 |
| 4,338,730 | A | 7/1982 | Tatsumi et al. | |
| 4,397,101 | A * | 8/1983 | Rickard | 34/486 |
| 4,520,259 | A | 5/1985 | Schoenberger | |
| 4,649,654 | A | 3/1987 | Hikino et al. | |
| 4,689,896 | A | 9/1987 | Narang | |
| 4,827,627 | A | 5/1989 | Cardoso | |
| 4,891,892 | A | 1/1990 | Narang | |
| 5,546,673 | A * | 8/1996 | Weagraff et al. | 34/80 |
| 5,555,645 | A * | 9/1996 | Joslin | 34/499 |
| 6,085,443 | A * | 7/2000 | Hunter et al. | 34/535 |
| 6,681,497 | B1 * | 1/2004 | Bria et al. | 34/79 |

* cited by examiner

*Primary Examiner*—Kenneth Rinehart
(74) *Attorney, Agent, or Firm*—George Rideout, Jr.; Armstrong Teasdale LLP

(57) ABSTRACT

A method of controlling the operation of a dryer including both a variable heat source and a variable speed blower includes varying only one of the variable heat source and the variable speed blower, while maintaining the other one in a fixed state.

23 Claims, 15 Drawing Sheets

CLOTHES DRYER APPARATUS AND METHOD

BACKGROUND OF THE INVENTION

This invention relates generally to clothes dryers and, more specifically, to control algorithms for clothes dryers.

An appliance for drying articles such as a clothes dryer typically includes a cabinet including a rotating drum for tumbling clothes and laundry articles therein. One or more heating elements heat air prior to the air entering the drum. The warm air is circulated through the drum as the clothes and laundry items are tumbled to remove moisture from the articles in the drum.

At least one known clothes dryer utilizes an open loop control system to determine an appropriate amount of time for drying a load of clothes. The drying time is determined by an operator and entered using a manual control, such as a time selector switch. For the duration of the drying time, the heating elements are activated and deactivated to maintain warm air circulation inside the drum, and for more accurate control of the dryer heating elements, a temperature sensor is sometimes used in conjunction with the heating elements. The operator selects a drying time based on the desired dryness for the clothes and based on past experience with the particular machine. A longer drying time than is necessary to fully dry the clothes is commonly selected to ensure that the clothes are fully dried. Use of more time than is needed for effective drying, however, is wasteful.

On at least some known dryers, the heating elements are often turned completely off to maintain air temperature below a maximum allowable temperature, while the blower on known residential dryers is driven at a constant speed for the total drying time. These approaches may not facilitate lowering drying time, improving dryer efficiency, or reducing electrical energy consumption.

BRIEF DESCRIPTION OF THE INVENTION

In one aspect, a method of controlling the operation of a dryer including both a variable heat source and a variable speed blower includes varying only one of the variable heat source and the variable speed blower, while maintaining the other one in a fixed state.

In another aspect, a dryer for tumble drying articles includes a drum including a cavity configured to hold articles to be dried, a first motor drivingly coupled to the drum to rotate the drum, a variable heat source in flow communication with the cavity, and a variable speed motor drivingly coupled to a blower positioned to deliver air heated by the heat source to the cavity.

In another aspect, a dryer control system is provided for a tumble type dryer having a variable heat source and a variable speed blower motor driving the blower to supply air heated by the heat source to the dryer cavity through a cavity inlet and exhaust air from the dryer cavity through a cavity outlet. The dryer control system includes at least one temperature sensor positioned to sense a temperature associated with the dryer and generate a temperature signal representative of the sensed temperature, and at least one pressure sensor positioned to sense a pressure associated with the dryer and generate a pressure signal representative of the sensed pressure. A controller is operatively coupled to the at least one temperature sensor and the at least one pressure sensor and is configured to receive the temperature and pressure signals and control the operation of at least one of the variable speed blower motor and the variable heat source based on at least one of the received signals.

In yet another aspect, a heater control for a tumble type dryer includes a heater element supplying heated air to a drum including a cavity, at least one temperature sensor providing a signal indicative of cavity outlet temperature, and a controller operatively coupled to the heater element and the at least one temperature sensor and configured to vary at least one of a voltage and a current to the heater element based on the signal from the temperature sensor to substantially maintain a predetermined cavity outlet temperature.

In still another aspect, a method for controlling a clothes dryer including a variable blower, a variable heater, and a drum having a cavity configured for holding articles includes installing a controller on the dryer operatively coupled to the blower and heater and in communication with a cavity inlet temperature sensor providing a signal indicative of cavity inlet temperature and a cavity outlet temperature sensor providing a signal indicative of cavity outlet temperature, establishing a predetermined maximum cavity inlet temperature and a predetermined maximum cavity outlet temperature, receiving a signal in the controller from the inlet and outlet temperature sensors, and controlling the blower duty based on the received temperature sensor signals to attempt to maintain the cavity inlet and outlet temperatures below the respective predetermined maximum temperatures. The heater element is controlled to maintain the cavity inlet and outlet temperatures below the respective predetermined maximum temperatures when the attempt to maintain the cavity inlet and outlet temperatures below the respective predetermined maximum temperatures by controlling blower duty is unsuccessful.

Alternatively, a dryer control system is provided for a tumble type dryer having a variable heat source and a variable speed blower motor driving the blower to supply air heated by the heat source to the dryer cavity through a cavity inlet and exhaust air from the dryer cavity through a cavity outlet. The system includes at least one temperature sensor positioned to sense a temperature associated with the dryer and configured to generate a temperature signal representative of the sensed temperature, and a controller operatively coupled to the temperature sensor and configured to receive the temperature signals. The controller is configured to control the operation at least one of the variable speed blower motor and the variable heat source in a plurality of control modes based on the received signals.

DETAILED DESCRIPTION OF THE INVENTION

Figure 1:
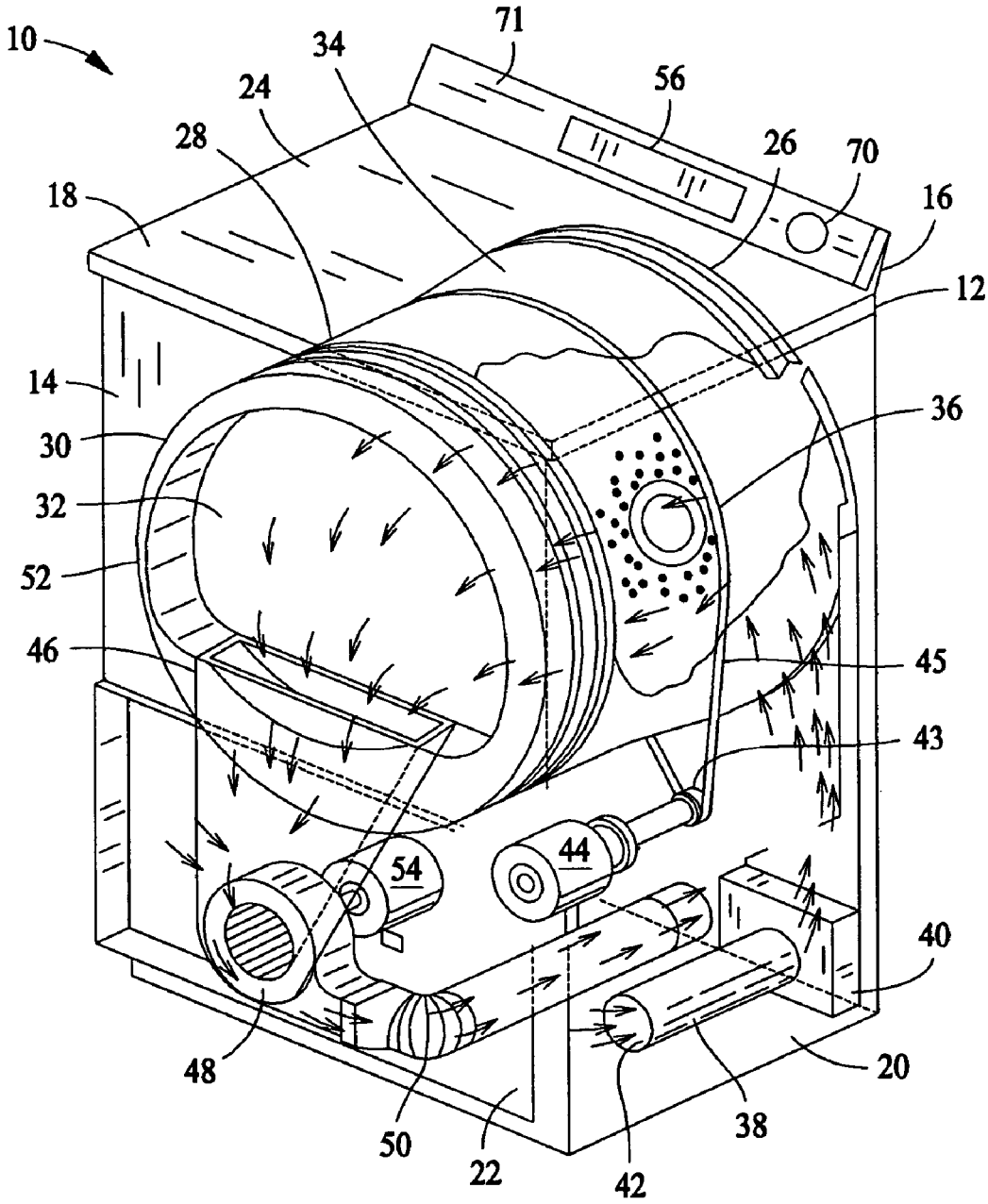
FIG. 1 is perspective broken away view of an exemplary dryer appliance.

FIG. 1 illustrates an exemplary clothes dryer appliance 10 in which the herein described methods and apparatus may be practiced. While described in the context of a specific embodiment of dryer 10, it is recognized that the benefits of the herein described methods and apparatus may accrue to other types and embodiments of dryer appliances. Therefore, the following description is set forth for illustrative purposes only, and the herein described methods and apparatus is not intended to be limited in practice to a specific embodiment of a dryer appliance, such as dryer 10, rather, the methods and apparatus described herein are intended to apply to apparatuses generally which include blowing and heating operations in combination.

Clothes dryer 10 includes a cabinet or a main housing 12 including a front panel 14, a rear panel 16, a pair of side panels 18 and 20 spaced apart from each other by front panel 14 and rear panel 16, a bottom panel 22, and a top cover 24. Within cabinet 12 is a drum or container 26 mounted for rotation around a substantially horizontal axis. A motor 44 rotates drum 26 about the horizontal axis through a pulley 43 and a belt 45. Drum 26 is generally cylindrical in shape, having an imperforate outer cylindrical wall 28 and a front flange or wall 30 defining an opening 32 to drum 26 for loading and unloading of clothing articles and other fabrics.

A plurality of tumbling ribs (not shown) are provided within drum 26 to lift clothing articles therein and then allow them to tumble back to the bottom of drum 26 as the drum rotates. Drum 26 includes a rear wall 34 rotatably supported within the main housing 12 by a suitable fixed bearing. Rear wall 34 includes a plurality of holes 36 that receive hot air that has been heated by an electrical heater 40 in communication with an air supply duct 38 and duct inlet 42. The heated air is drawn from the drum 26 by a blower fan 48 which is driven by a blower motor 54. The air passes through a screen filter 46 which traps any lint particles. As the air passes through the screen filter 46, it enters a trap duct seal and is passed out of the clothes dryer through an exhaust duct 50. After the clothing articles have been dried, they are removed from drum 26 via opening 32.

In this detailed description, reference will be made to blower motor 54 and heater 40 operating in a fixed state which is synonymous with a fixed duty cycle. A duty cycle, or state, refers to the application of a power level applied to motor 54 or heater 40. It is to be understood that, even at a fixed power level, there may be some variation in motor speed or heater output resulting from variations in load or other factors external to motor 54 and heater 40.

A cycle selector knob 70 is mounted on a cabinet backsplash 71 and is in communication with a control system 56. Signals generated in control system 56 operate drum 26 and heating elements 40 in response to a position of selector knob 70. Blower motor 54 is a variable speed motor that is controlled by control system 56.

Figure 2:
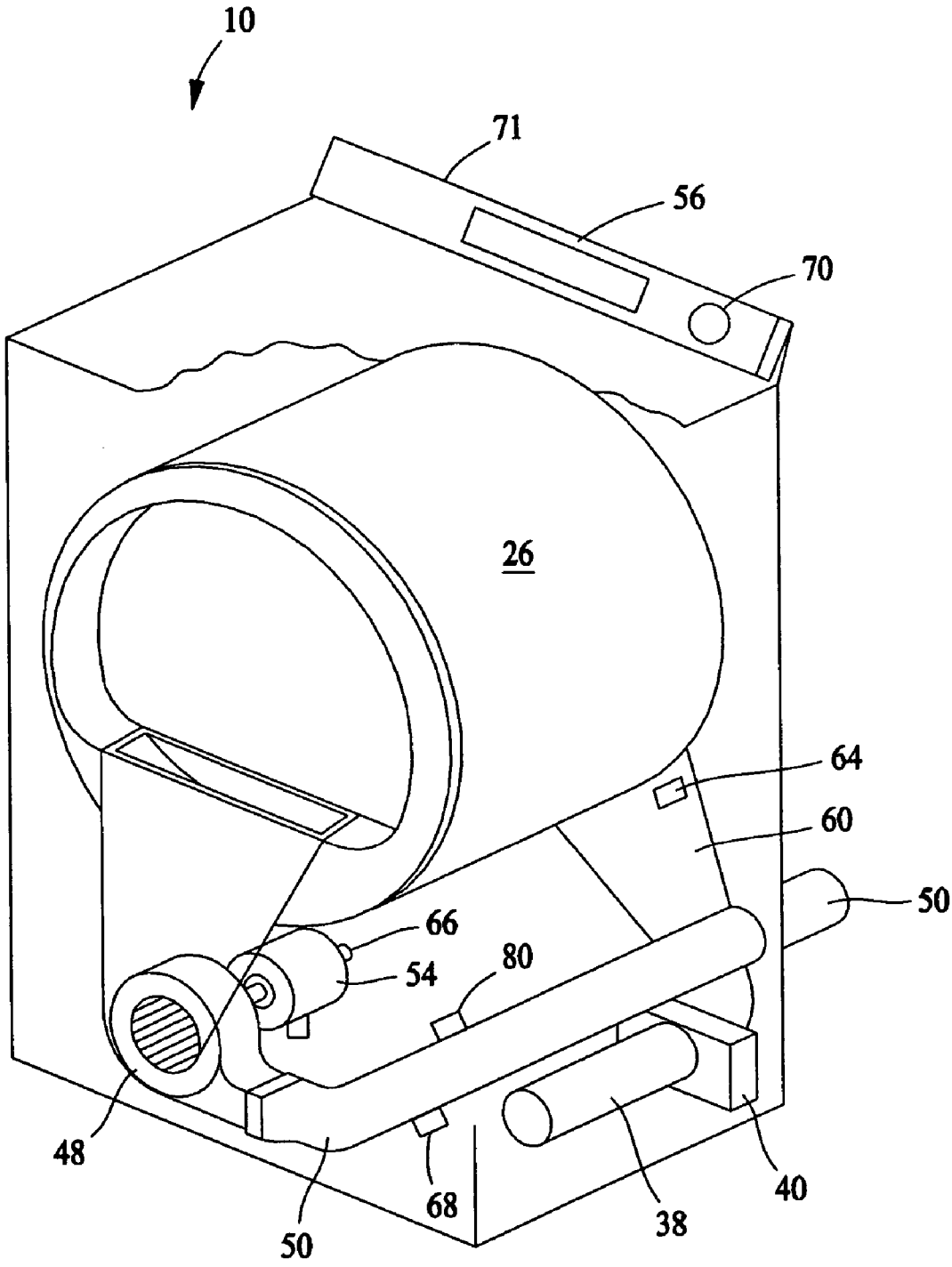
FIG. 2 is a perspective broken away view of a dryer appliance showing sensor locations.

With reference to FIG. 2, dryer 10 includes a temperature sensor 64 at drum hot air inlet 60 operable to produce a temperature signal indicative of an inlet air temperature. A second temperature sensor 68 is operable to produce a temperature signal indicative of a drum outlet temperature in outlet duct 50. A pressure sensor 80 is operable to produce a pressure signal indicative of air pressure in outlet duct 50. An inverter 66 regulates the frequency of the electric current supplied to motor 54 to control the operation of motor 54.

Figure 3:
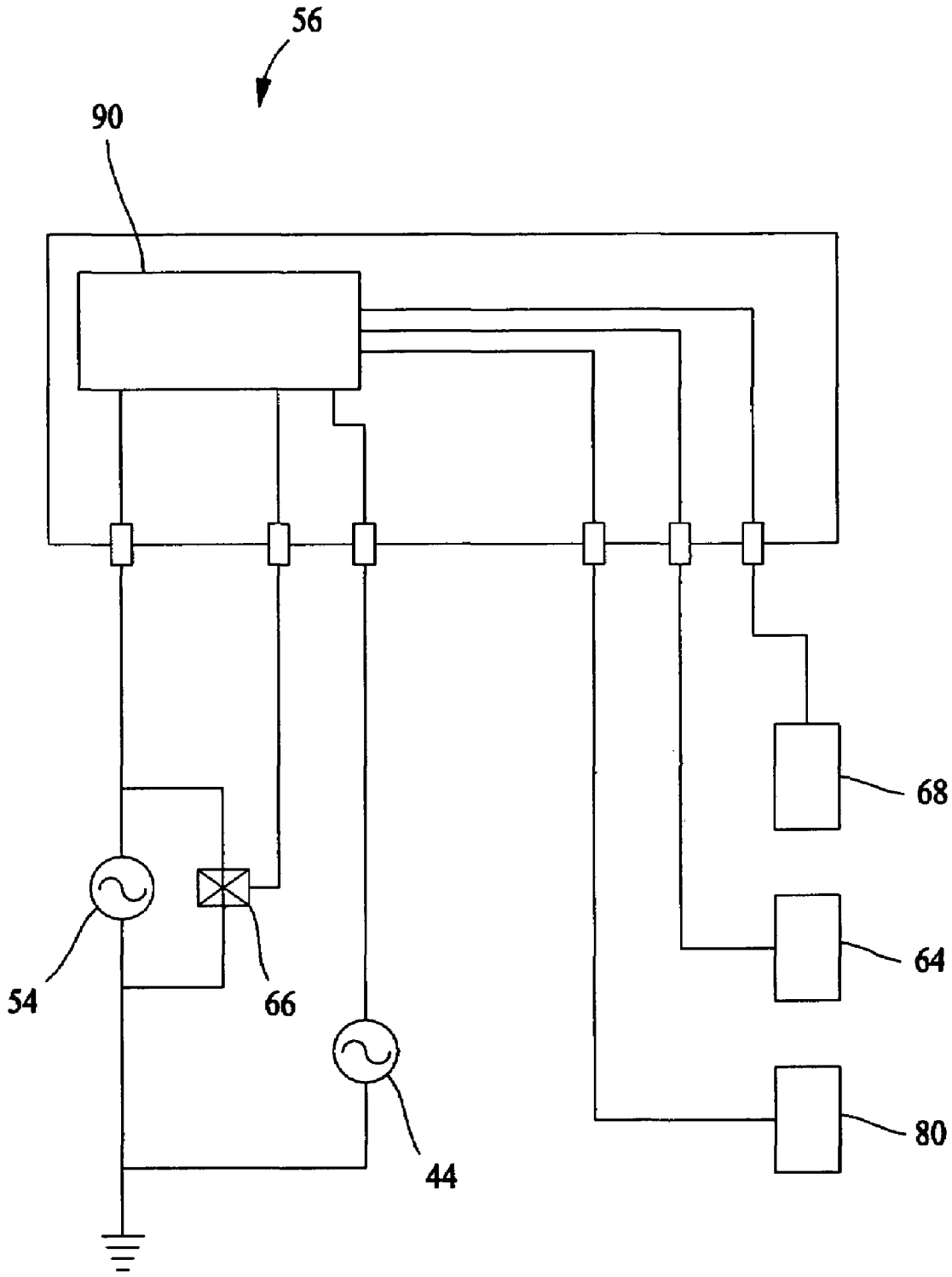
FIG. 3 is a schematic diagram of a controller control circuit for controlling a blower in a dryer.

FIG. 3 is a schematic block diagram of control system 56 including a controller 90 which is in communication with temperature sensors 64 and 68 and pressure sensor 80. Controller 90 also is in communication with drum motor 44, inverter 66, and variable speed motor 54. Controller 90 is programmed to perform functions described herein, and as used herein, the term controller is not limited to just those integrated circuits referred to in the art as controllers, but broadly refers to microprocessors, computers, processors, microcontrollers, microcomputers, programmable logic controllers, application specific integrated circuits, field programmable gate arrays, and other programmable circuits, and these terms are used interchangeably herein.

In operation, a user selects a drying cycle through control system 56. Controller 90 then controls motor 54 to vary the speed of blower fan 48. Controller 90 contains multiple program algorithms associated with the drying options available to the user through control system 56. For example, in one drying cycle controller 90 directs inverter 66, controlling the duty cycle of inverter 66, to maintain motor 54, and thus blower fan 48, at a constant duty. For another drying cycle, controller 90 directs inverter 66 to vary the speed of motor 54 and blower fan 48 based on temperature feedback from one or both of temperature sensors 64 and 68. For another drying cycle, controller 90 signals inverter 66 to vary the speed of motor 54 and blower fan 48 based on pressure feedback from pressure sensor 80.

In another embodiment, controller 90 directs inverter 66 to operate motor 54 at a constant torque. In this mode, inverter 66 is similar to a pressure sensor in that inverter 66 automatically responds to varying pressures. Factors that affect pressure within duct 50 include lint buildup or a length of outlet duct 50, including the venting distance to the outside of the home for establishing an optimal drying time. Back pressure also varies with load size and will vary with a given load as the drying process progresses. In another drying cycle, an algorithm directs controller 90 to control motor 54 based on a combination of temperature signals from drum inlet temperature sensor 64 and drum outlet temperature sensor 68 and pressure sensor 80 to vary airflow from blower fan 48 to facilitate a reduction in drying time.

In another embodiment, controller 90 is programmed to determine a ducting pressure loss based on the pressure signal from pressure sensor 80 and regulate the operation of motor 54 based on the determined ducting pressure loss. In one embodiment, controller 90 regulates the operation of motor 54 based on the outlet temperature of drum 26 to maintain a constant inlet air temperature setpoint for drum 26. In yet another drying cycle, controller 90 is programmed to regulate the operation of motor 54 based on a signal indicative of clothes load (e.g. weight) in drum 26.

From the preceding, it is shown that various methods are available to control variable speed blower motor 54. In an exemplary embodiment, control system 56 receives a signal from temperature sensor 68 and pressure sensor 80, and control system 56 controls the operation of blower motor 54 based on the received pressure and temperature signals. One method also includes controlling blower motor 54 based on the load size in drum 26. Load size can be selectively set by the user or automatically determined by measuring an increase of the weight of drum 26 due to the clothes load. One method also includes controlling blower motor 54 to maintain a constant inlet air setpoint for the dryer.

In describing one method in more detail, controller 90 executes one of several algorithms stored therein to control blower motor 54 based on the selection of a drying cycle by the user of the dryer. Controller 90 controls the operation of blower motor 54 based on the received temperature and pressure signals and load size indications. In one embodiment, inverter 66 is operatively coupled to blower motor 54 wherein control of blower motor 54 is accomplished by controlling the duty cycle of inverter 66 based on temperature. In an exemplary embodiment, control system 56 directs inverter 66 to control motor 54 at a constant torque and varies the duty cycle to inverter 66 based upon sensed temperature to adapt to different pressures for different ducting conditions while also controlling inverter 66 based on temperature.

Figure 4:
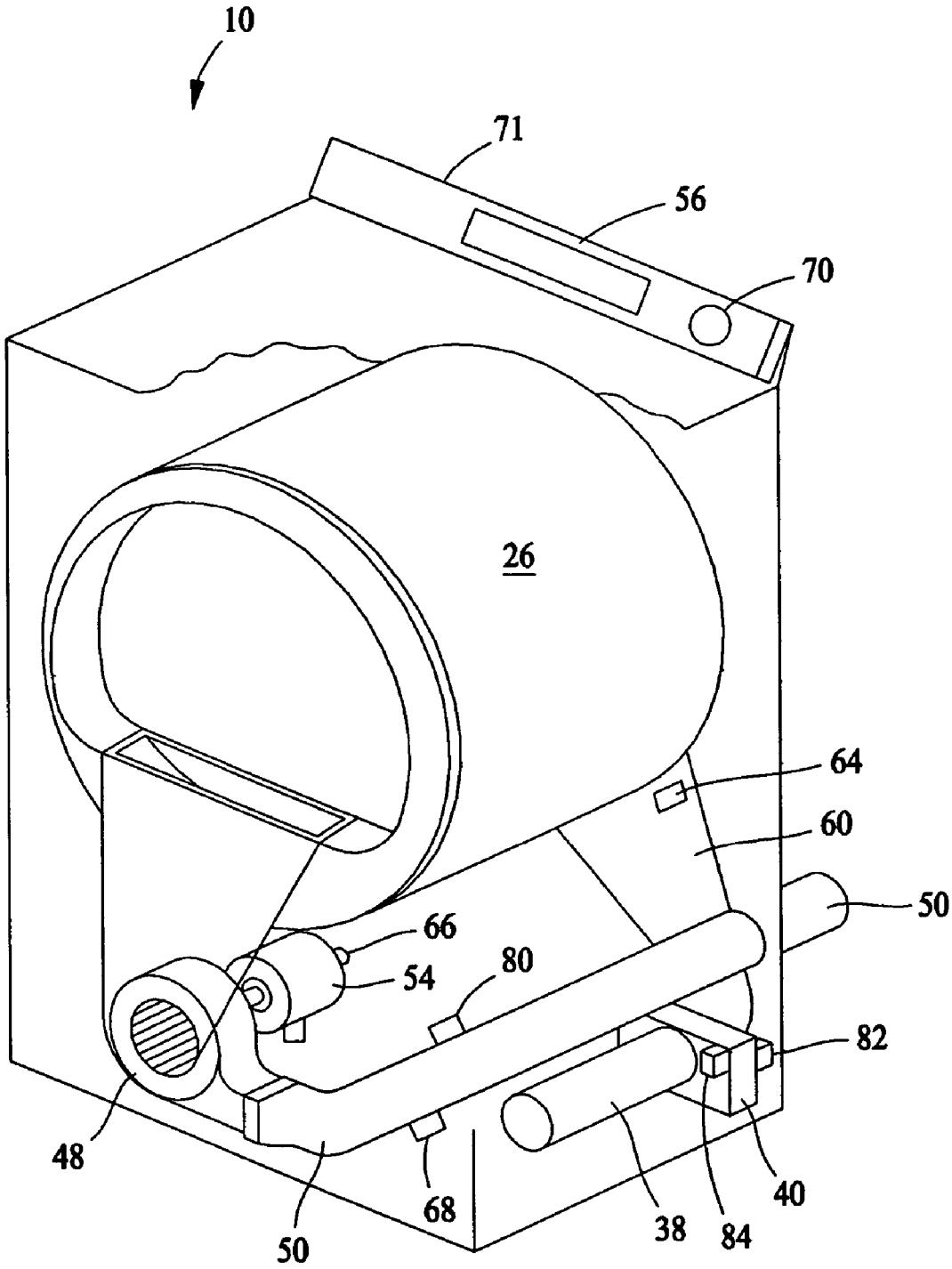
FIG. 4 is a perspective broken away view of a dryer showing sensor locations.

With reference now to FIG. 4, dryer 10 is shown with the addition of a voltage control 82 and a current control 84, both coupled to electrical heater 40. With voltage control 82 and current control 84, a heater control is provided that includes electrical heater 40, drum inlet temperature sensor 64, drum outlet temperature sensor 68, and control system 56.

Figure 5:
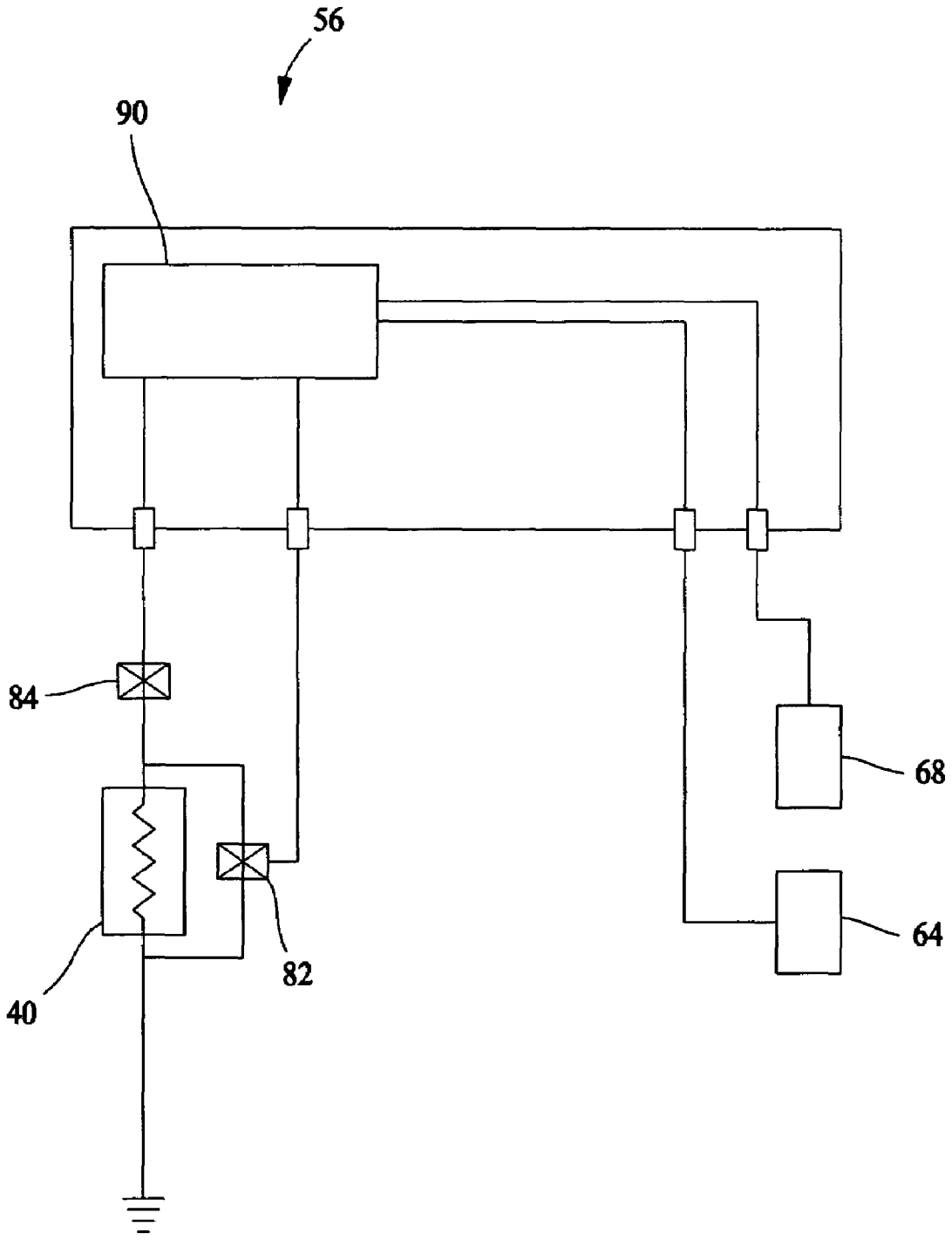
FIG. 5 is a schematic diagram of a controller control circuit for controller a heating element in a dryer.

The control circuitry for the heater control portion of control system 56 is shown schematically in FIG. 5. Control system 56 includes a controller 90 which is in communication with temperature sensors 64 and 68, voltage control 82, and current control 84.

When the heater control is in operation, the user selects a drying cycle through control system 56 for a particular fabric type. Controller 90 then monitors the drum outlet temperature from temperature sensor 68 and signals voltage control 82 to linearly vary the voltage to electrical heater 40, and/or signals current control 84 to vary the current to electrical heater 40, to maintain a predetermined drum outlet temperature. The drum outlet temperature is maintained slightly below a maximum allowable temperature for the fabric type being dried. Controller 90 is configured to gradually reduce the voltage, and/or current, to electrical heater 40 rather than turning electrical heater 40 completely off. In another embodiment, both the drum inlet air temperature and outlet air temperature are monitored as a basis for control of electrical heater 40.

Though described separately above, it should be understood that heater control and blower control functions may operate concurrently in some drying cycles. For example, in one drying cycle, controller 90 is programmed to maintain the temperature within drum 26 below a predetermined maximum value by varying the speed of blower motor 54. However, if conditions are such that the maximum temperature is reached, controller 90 then reduces the voltage and/or current to heater 40 to maintain the drum temperature below the predetermined maximum.

FIGS. 6 through 15 are of flow diagrams of the algorithms that control the dryer cycles of dryer 10. The dry cycle is made up of several phases each of which has a specific function. Certain events however occur during all cycles. For instance, all systems must be turned off when the dryer door is opened or the pause function is selected on the user interface. Normal operations resume once the door is closed and the start button is pressed or continue/resume is selected on the user interface.

Figure 6:
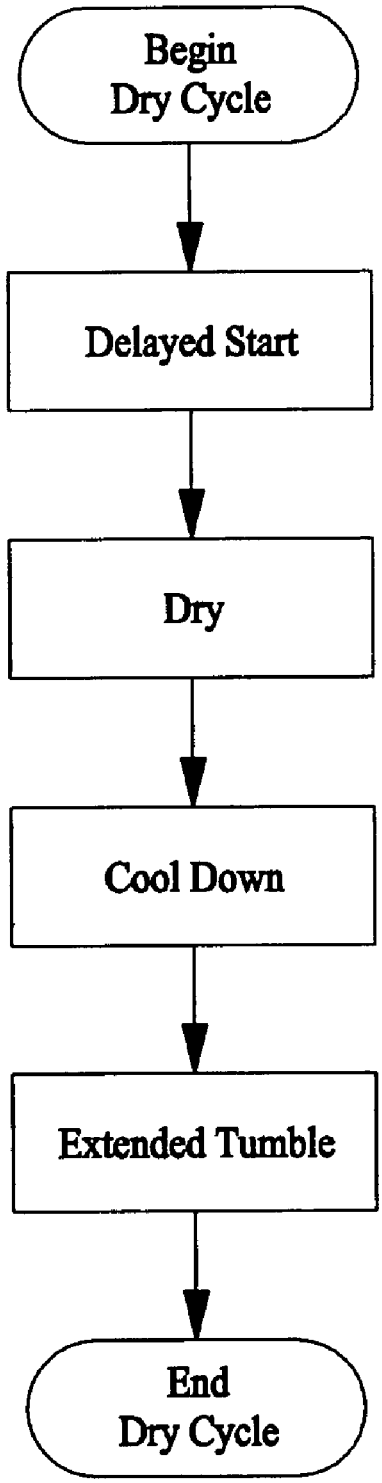
FIG. 6 is a flow diagram of a general dry cycle template.

FIG. 6 illustrates a flow diagram of a general dry cycle template.

Figure 7:
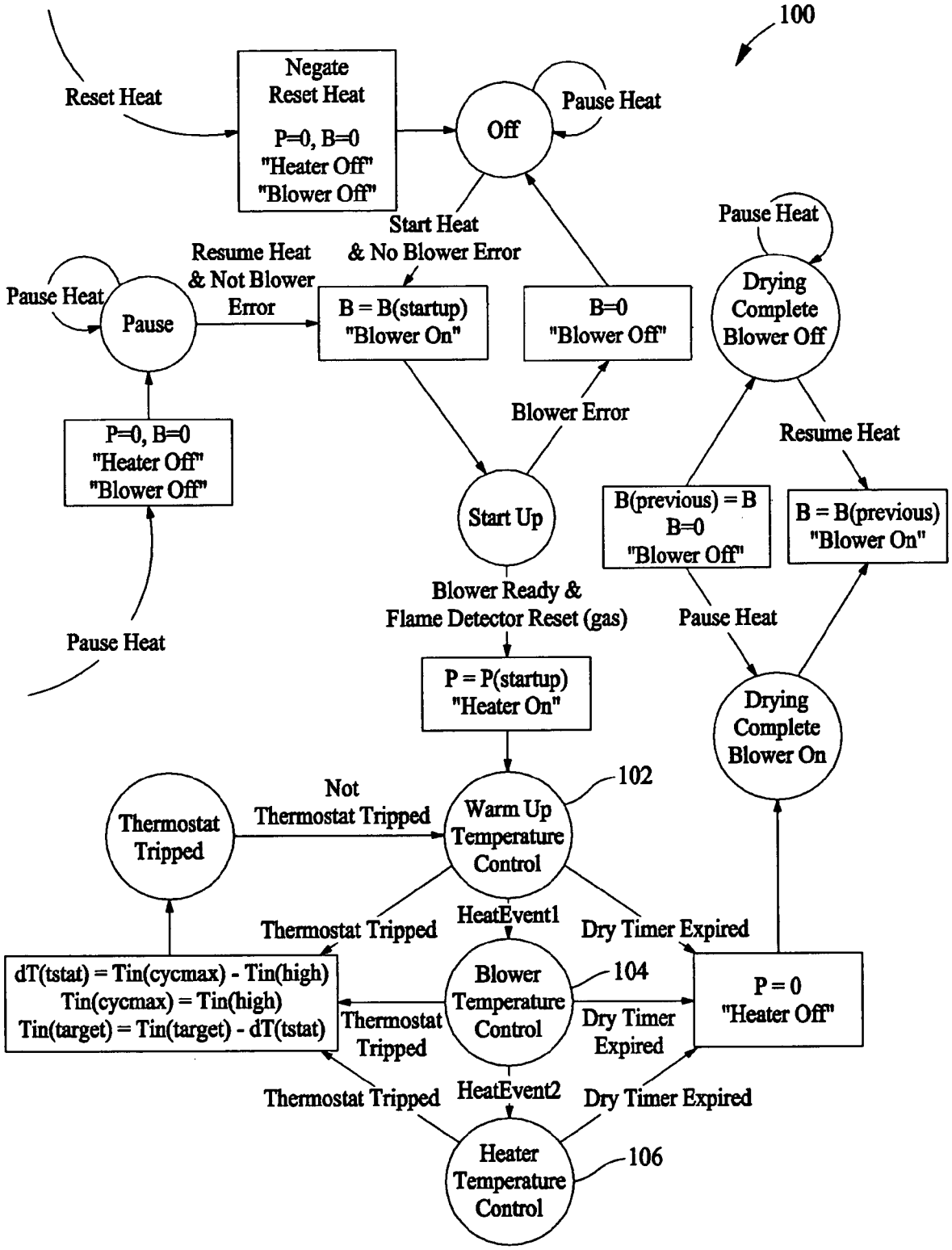
FIG. 7 is a flow diagram of the dry process of FIG. 6.

FIG. 7 illustrates a flow diagram of a dry process 100. The dry process 100 is the main process that manages the heater 40 and the blower 54. It runs continuously and concurrently with any other processes. Three temperature control modes are used. The first mode is a warm up temperature control mode 102 (see FIG. 8) that brings the temperature up quickly without overshooting a target temperature. The second is a blower control mode 104 (see FIG. 9) that attempts to maintain a target temperature by adjusting the blower duty. If the blower control mode is unsuccessful at maintaining the target temperature, a third mode, the heater control mode 106 (see FIG. 10), is used to maintain the temperature by adjusting a heater power level. The warm up, blower control, and heater control modes 102, 104, and 106 respectively do not operate concurrently, rather, the dry process 100 invokes the blower control mode 104 and heater control mode 106 after warm up mode 102 and after the occurrence of a particular Heat Event as will be described.

Tin(cycmax) is the maximum allowed temperature for the cycle that is running. Tin(target) is the current control point for the inlet drying temperature. Tin(high) is the highest measured inlet temperature before a thermostat trip event.

Figure 8:
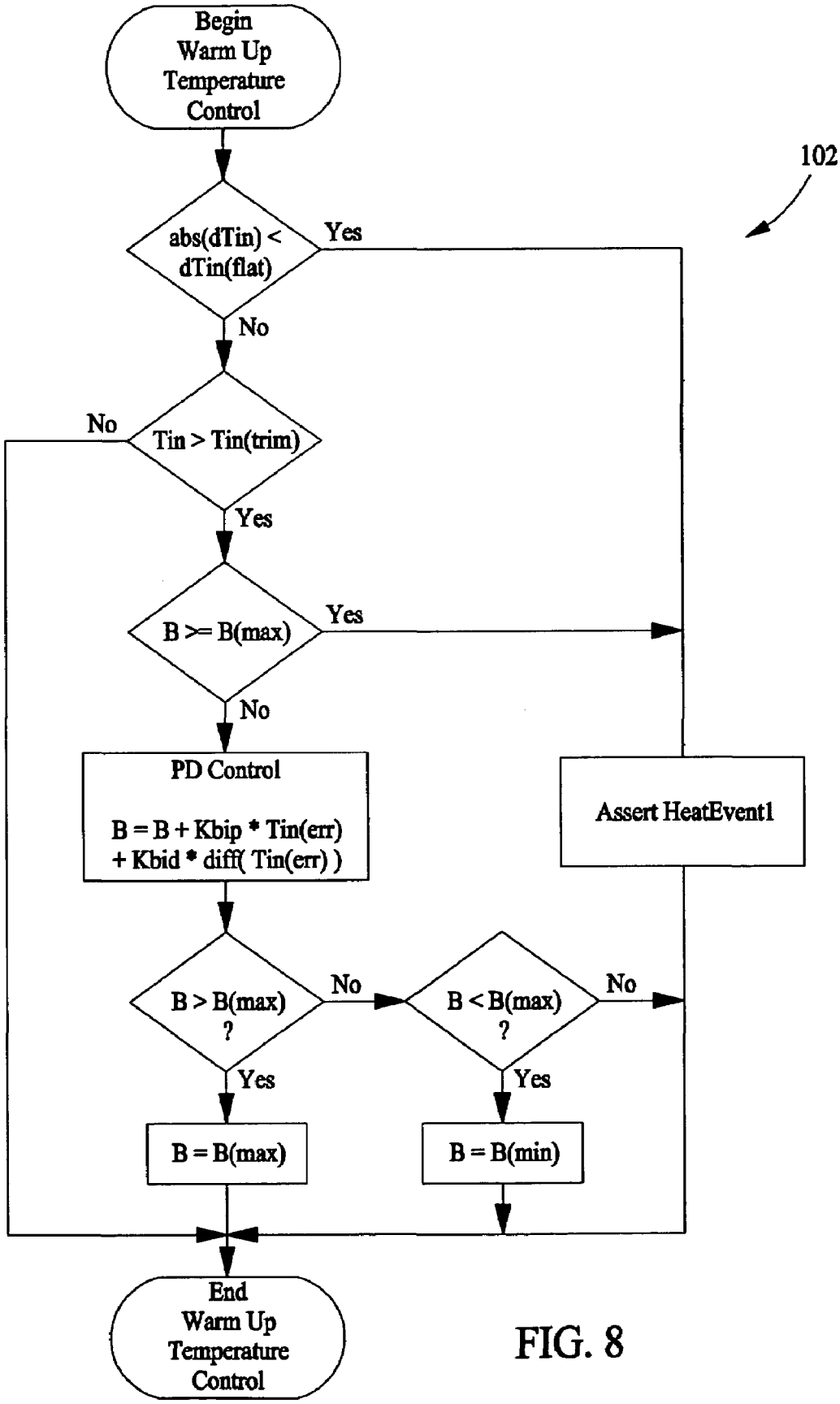
FIG. 8 is a flow diagram of a heater warm-up process in the dry process of FIG. 7.

FIG. 8 illustrates a flow diagram of the heater warm up mode 102 of the dry process previously described. Warm up mode 102 is the first mode activated when the dryer is turned on. Warm up mode 102 is provided to allow the dryer to come up to temperature and stabilize.

Tin(trim) is a threshold temperature used in the warm up temperature mode to inhibit overshooting the target temperature. dTin(flat) represents the maximum limit of abs (dTin) such that Tin, the dryer inlet temperature can be considered to be stabilized. Warm up mode 102 asserts Heat Event1 when the temperature is stabilized as indicated above, or if the blower speed (B) reaches its maximum speed and Tin(trim) has been reached. Tin(trim) is a threshold temperature used to limit overshooting of the target temperature. When Heat Event1 occurs, the dry process 100 invokes the blower control mode 104.

Figure 9:
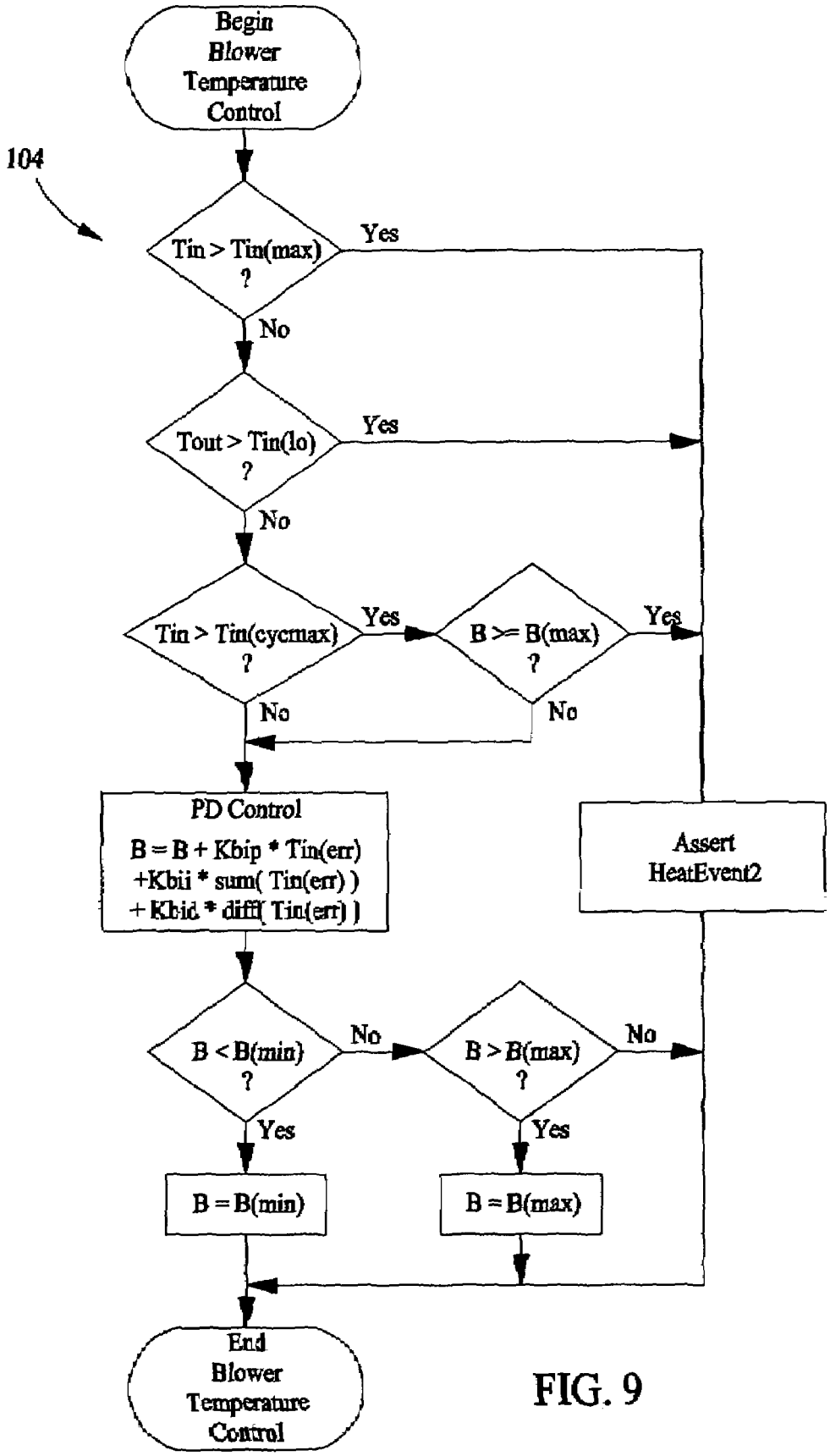
FIG. 9 is a flow diagram of a blower control mode process in the dry process of FIG. 7.

FIG. 9 illustrates a flow diagram of the blower control mode 104 of the dry process previously described. Blower control mode 104 is activated upon the occurrence of Heat Event1. In blower control mode, control process 100 attempts to control the dryer temperatures using only the variable speed blower. Tin(max) represents the maximum inlet temperature allowed for electronic dryer control. Tout (lo) is a warning threshold temperature before a maximum dryer outlet temperature is reached. If the dryer inlet temperature reaches Tin(max), or the dryer outlet temperature reaches the Tout(lo) threshold, blower control process asserts Heat Event2. Heat Event2 is also asserted if the inlet temperature exceeds the maximum temperature allowed for the cycle that is running and the blower is operating at a maximum speed. When Heat Event2 occurs, the heater temperature control mode 106 is invoked.

Figure 10A:
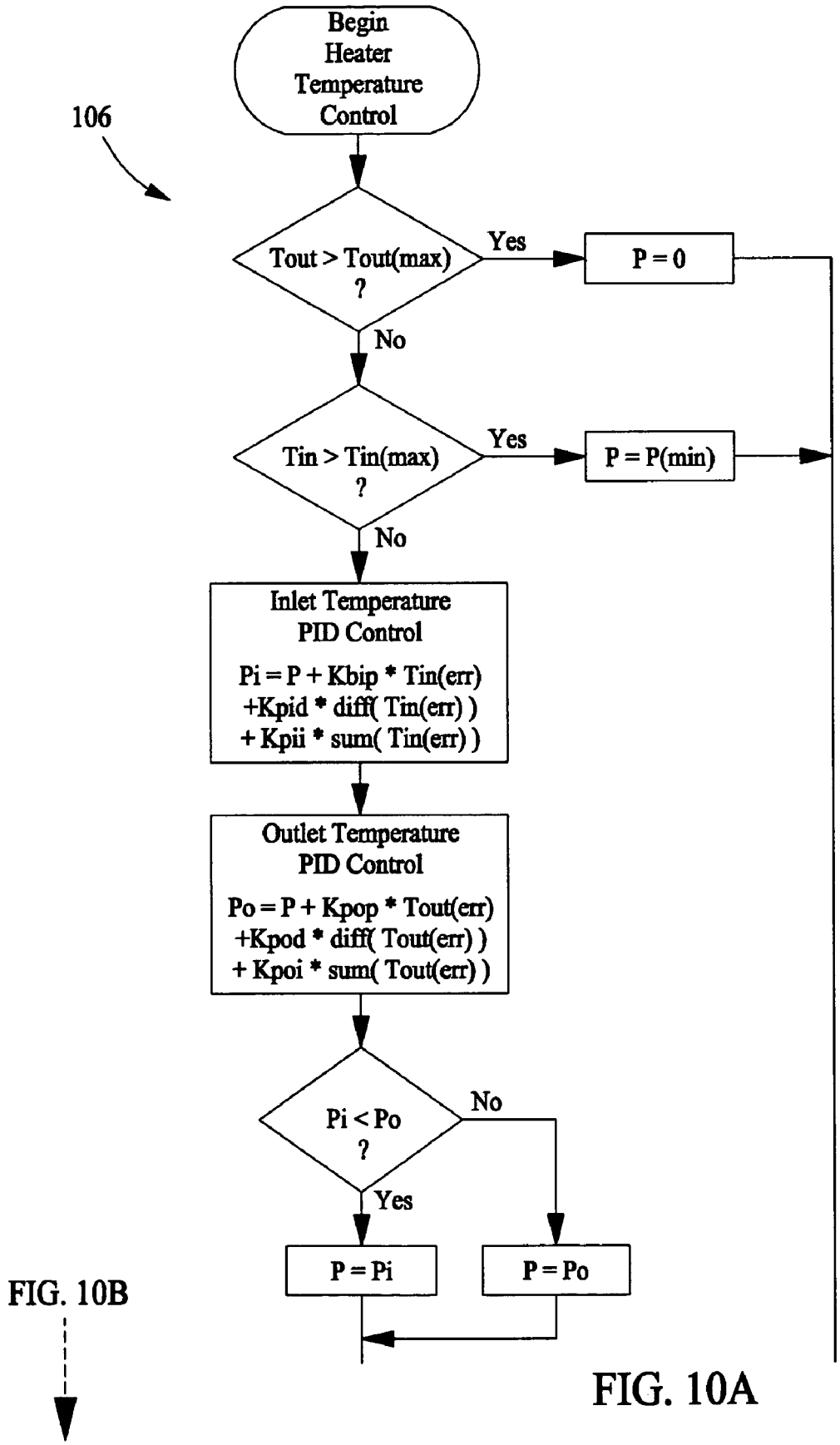
FIG. 10 is a flow diagram of a heater control mode process in the dry process of FIG. 7.
Figure 10B:
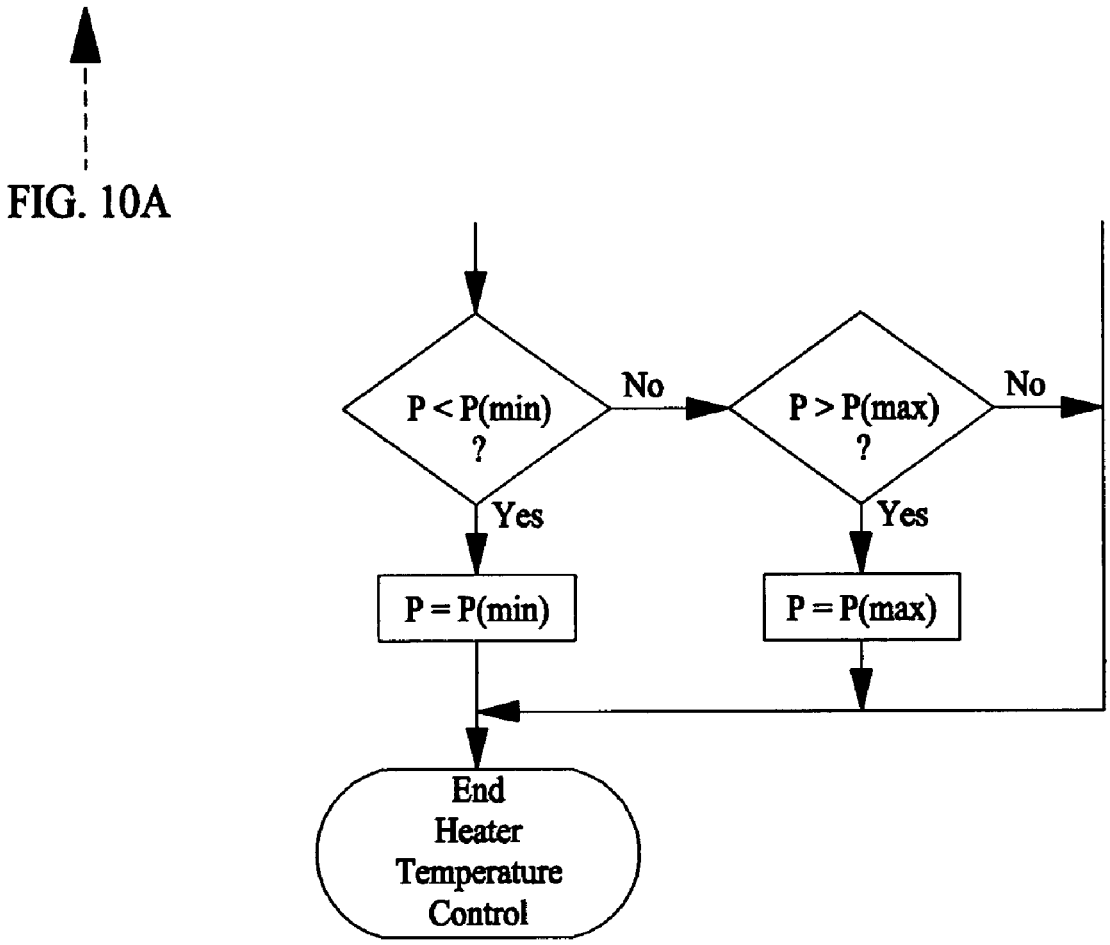

FIG. 10 illustrates a flow diagram of the heater control mode 106 in the dry process previously described. Heater control mode 106 is activated upon the occurrence of Heat Event2 where blower control is unsuccessful in maintaining the target temperature. Heater control mode 106 monitors the dryer inlet and outlet temperatures and adjusts the heater power level P to control the inlet and outlet temperatures.

Figure 11:
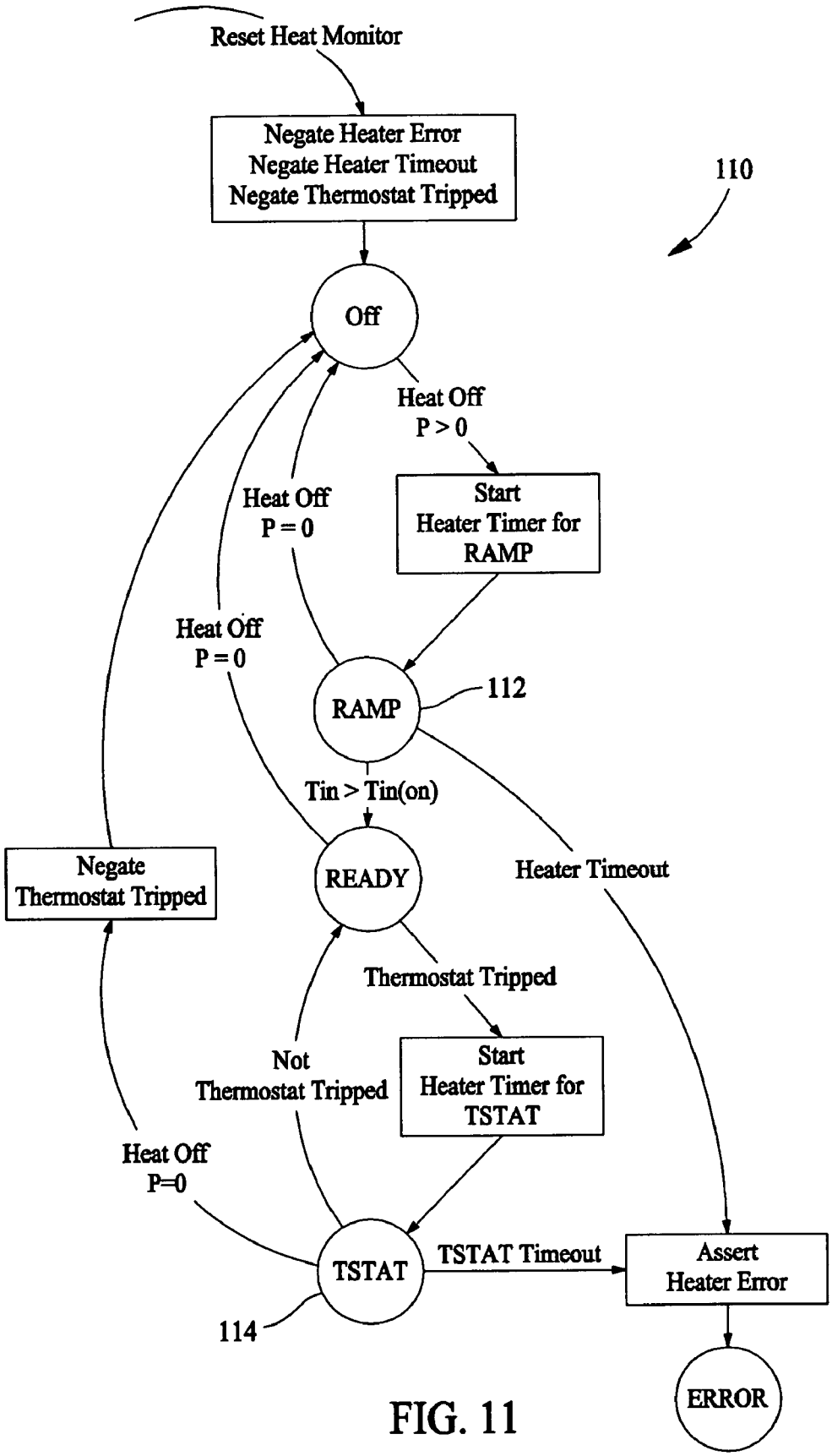
FIG. 11 is a flow diagram of a heater monitor process.

FIG. 11 illustrates a flow diagram of a heater monitor process 110. This process works with the dry process 100 to monitor the temperature when the heater is turned on to determine whether the heater is working or the heater control thermostat has tripped.

Figure 12:
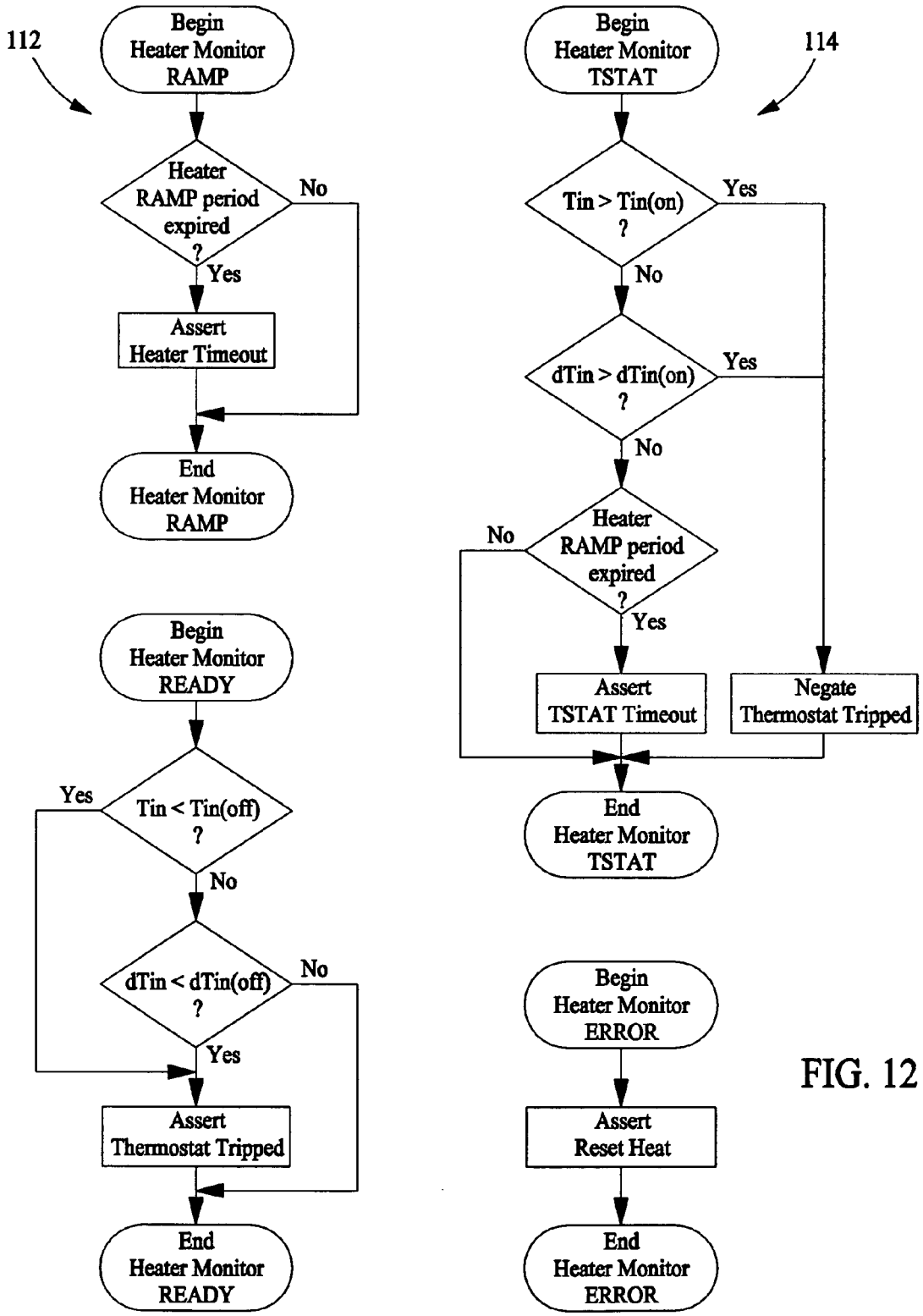
FIG. 12 is a flow diagram of the sub-routines of the heater monitor process of FIG. 11.

FIG. 12 illustrates a flow diagrams of RAMP sub-routine 112 and TSTAT sub-routine 114 of the heater monitor process 110 previously described.

Figure 13:
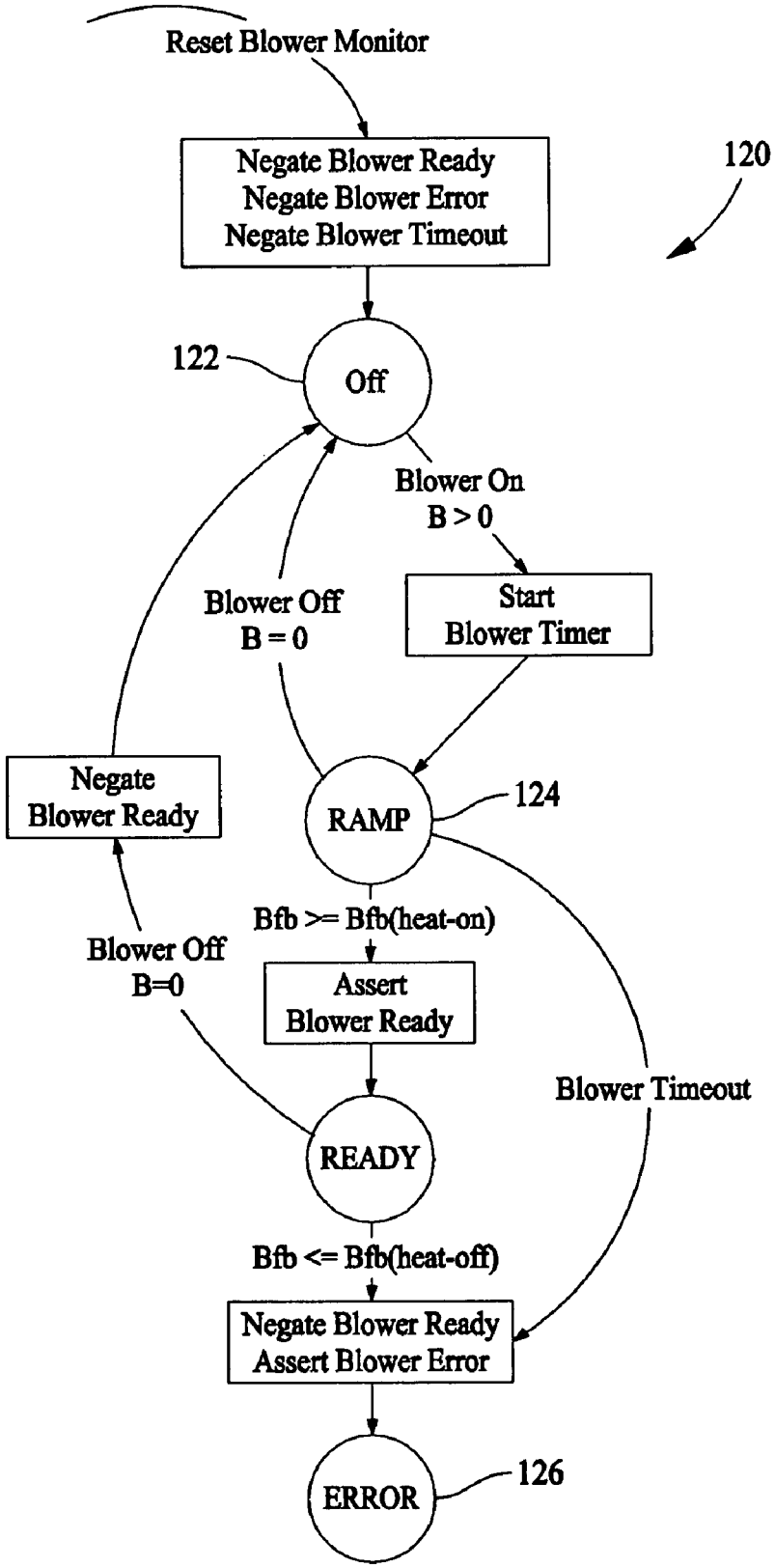
FIG. 13 is a flow diagram of a blower monitor process.

FIG. 13 illustrates a flow diagram of a blower monitor process 120. The blower monitor process works with the dry process 100 to monitor blower speed. A blower error is detected if it takes too long for the blower to come up to speed or, once running, if the blower speed drops unexpectedly. For redundancy, the heater power is turned off while the blower comes up to speed and the dry process is held in a reset mode when any blower error is detected.

Figure 14:
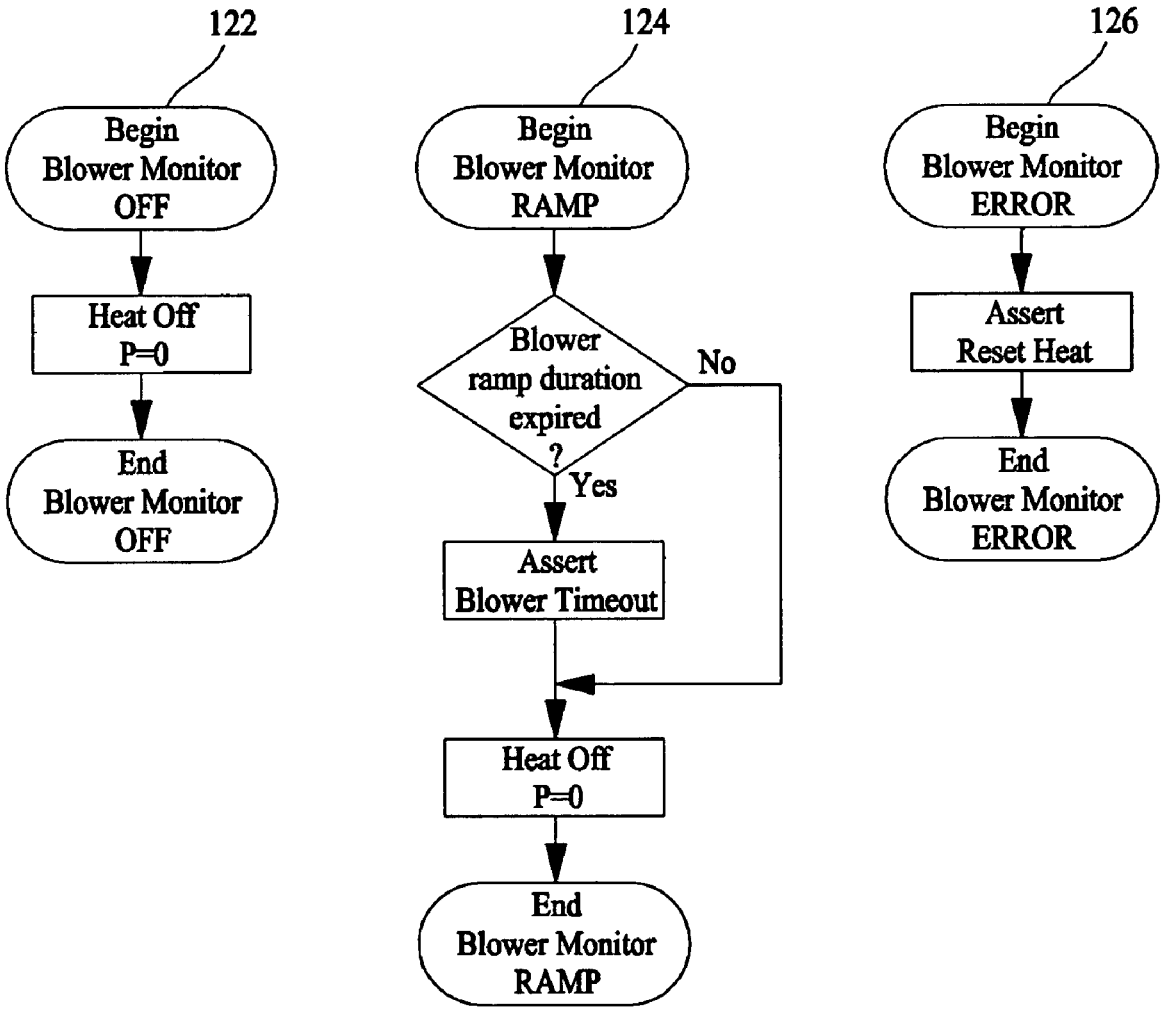
FIG. 14 is a flow diagram of the sub-routines of the blower monitor process of FIG. 13.

FIG. 14 illustrates flow diagrams of the OFF sub-routine 122, RAMP sub-routine 124, and ERROR sub-routine 126 of the blower monitor process 120 previously described.

The embodiments thus described provide a dryer control for a clothes dryer with a variable speed blower motor and a variable heater element that allows the dryer to be operated in a manner that facilitates improving dryer efficiency, reducing energy consumption, and lowering drying time which also facilitates extending the useful life of the dryer.

While the invention has been described in terms of various specific embodiments, those skilled in the art will recognize that the invention can be practiced with modification within the spirit and scope of the claims.

What is claimed is:

1. A method of controlling the operation of a dryer including both a variable heat source and a variable speed blower, a drum including a cavity configured to hold an article to be dried, and a first motor drivingly coupled to the drum to rotate the drum, said method comprising:

rotating the drum;

varying only one of the variable heat source and the variable speed blower, while maintaining the other one in a fixed state;

wherein varying the variable speed blower comprises varying the variable speed blower between a first speed and a second speed greater than the first speed and in the same direction as the first speed;

fixing the variable heat source in a fixed state;

varying a speed of the variable speed blower;

monitoring the dryer for the occurrence of a heat event;

fixing the speed of the variable speed blower when the heat event occurs; and varying the variable heat source when the blower is in the fixed state.

2. A method in accordance with claim 1, wherein the heat event occurs when a predetermined maximum temperature associated with the dryer is exceeded.

3. A dryer for tumble drying articles comprising:

a drum comprising a cavity configured to hold articles to be dried;

a first motor drivingly coupled to said drum to rotate said drum;

a variable heat source in flow communication with said cavity;

a variable speed motor drivingly coupled to a blower positioned to deliver air heated by said heat source to said cavity, wherein said motor is variable between a first speed and a second speed greater than the first speed and in the same direction as the first speed; and a controller operatively coupled to said variable speed motor and said variable heat source and at least one pressure sensor operatively coupled to said controller and positioned to sense a pressure associated with the dryer and configured to generate a pressure signal representative of the sensed pressure, said controller operable to receive the pressure signal and control one of said variable speed motor and said variable heat source based on the pressure signal.

4. A dryer in accordance with claim 3 further comprising a controller operatively coupled to said variable speed motor and said variable heat source and at least one temperature sensor operatively coupled to said controller and positioned to sense a temperature associated with the dryer and generate a temperature signal representative of the sensed temperature, said controller operable to receive the temperature signal and control one of said variable speed motor and said variable heat source based on the temperature signal.

5. A dryer in accordance with claim 3 further comprising at least one temperature sensor operatively coupled to said controller and positioned to sense a temperature associated with the dryer and generate a temperature signal representative of the sensed temperature, said controller operable to receive the temperature signal and control one of said variable speed motor and said variable heat source based on the pressure signal and the temperature.

6. A dryer in accordance with claim 5 wherein said temperature signal is representative of a cavity inlet air temperature.

7. A dryer in accordance with claim 5 wherein said temperature signal is representative of a cavity outlet air temperature.

8. A dryer in accordance with claim 5 wherein said pressure signal is representative of a cavity outlet duct pressure.

9. A dryer control system for a tumble type dryer having a variable heat source and a variable speed blower motor driving the blower to supply air heated by the heat source to the dryer cavity through a cavity inlet and exhaust air from the dryer cavity through a cavity outlet, said system comprising:

at least one temperature sensor positioned to sense a temperature associated with the dryer and configured to generate a temperature signal representative of the sensed temperature, wherein the temperature signal is representative of a cavity inlet air temperature;

at least one pressure sensor positioned to sense a pressure associated with the dryer and configured to generate a pressure signal representative of the sensed pressure; and a controller operatively coupled to said at least one temperature sensor and said at least one pressure sensor and configured to receive the temperature and pressure signals and control the operation at least one of the variable speed blower motor and the variable heat source based on at least one of the received signals.

10. A dryer control system in accordance with claim 9 wherein said controller regulates the operation of the variable speed blower motor and said variable heat source based on the temperature signal to maintain the temperature below a predetermined maximum temperature.

11. A dryer control system for a tumble type dryer having a variable heat source and a variable speed blower motor driving the blower to supply air heated by the heat source to the dryer cavity through a cavity inlet and exhaust air from the dryer cavity through a cavity outlet, said system comprising:

at least one temperature sensor positioned to sense a temperature associated with the dryer and configured to generate a temperature signal representative of the sensed temperature, wherein the temperature signal is representative of a cavity outlet air temperature;

at least one pressure sensor positioned to sense a pressure associated with the dryer and configured to generate a pressure signal representative of the sensed pressure; and a controller operatively coupled to said at least one temperature sensor and said at least one pressure sensor and configured to receive the temperature and pressure signals and control the operation at least one of the variable speed blower motor and the variable heat source based on at least one of the received signals.

12. A dryer control system in accordance with claim 11 wherein said controller regulates the operation of the variable speed blower motor and said variable heat source based on the temperature signal to maintain the temperature below a predetermined maximum temperature.

13. A heater control for a tumble type dryer comprising:

a heater element supplying heated air to a drum comprising a cavity;

at least one temperature sensor providing a signal indicative of cavity outlet temperature; and a controller operatively coupled to said heater element and said at least one temperature sensor and configured to vary at least one of a voltage and a current to said heater element based on said signal from said temperature sensor to substantially maintain a predetermined cavity outlet temperature, while maintaining said heater element in an on state.

14. A heater control in accordance with claim 13 wherein said controller is further configured to receive a signal from a user representing a fabric type and substantially maintain a predetermined cavity outlet temperature based on the received signal representative of fabric type.

15. A heater control in accordance with claim 13 wherein said voltage is gradually reduced to substantially maintain said predetermined cavity outlet temperature.

16. A heater control in accordance with claim 15 wherein said voltage is gradually reduced linearly.

17. A heater control in accordance with claim 13 wherein said current is gradually reduced to substantially maintain said predetermined cavity outlet temperature.

18. A heater control in accordance with claim 17 wherein said current is gradually reduced linearly.

19. A heater control in accordance with claim 13 further comprising a moisture sensor providing a signal indicative of remaining moisture content in said cavity, said controller further configured to turn off said heater element when a predetermined moisture content is reached.

20. A method for controlling a clothes dryer including a variable blower, a variable heater, and a drum having a cavity configured for holding articles, said method comprising:

installing a controller on the dryer operatively coupled to the blower and heater and in communication with a cavity inlet temperature sensor providing a signal indicative of cavity inlet temperature and a cavity outlet temperature sensor providing a signal indicative of cavity outlet temperature;

establishing a predetermined maximum cavity inlet temperature and a predetermined maximum cavity outlet temperature;

receiving a signal in the controller from the inlet and outlet temperature sensors;

controlling the blower duty based on the received temperature sensor signals to attempt to maintain the cavity inlet and outlet temperatures below the respective predetermined maximum temperatures; and controlling the beater element to maintain the cavity inlet and outlet temperatures below the respective predetermined maximum temperatures when the attempt to maintain the cavity inlet and outlet temperatures below the respective predetermined maximum temperatures by controlling blower duty is unsuccessful.

21. A dryer control system for a tumble type dryer having a variable heat source and a variable speed blower motor driving the blower to supply air heated by the heat source to the dryer cavity through a cavity inlet and exhaust air from the dryer cavity through a cavity outlet, said system comprising:

at least one temperature sensor positioned to sense a temperature associated with the dryer and configured to generate a temperature signal representative of the sensed temperature; and a controller operatively coupled to said at least one temperature sensor and configured to receive the temperature signals, said controller configured to control the operation of at least one of the variable speed blower motor and the variable heat source in a plurality of control modes based on the received signals;

wherein the controller controls the operation of the variable speed blower motor between a first speed and a second speed greater than the first speed and in the same direction as the first speed.

22. A dryer control system in accordance with claim 21 wherein said plurality of control modes includes a warm-up mode, a blower control mode, and a heater control mode.

23. A dryer control system in accordance with claim 22 wherein said controller is configured to select one of said modes based on the occurrence of a heat event.

* * * * *

UNITED STATES PATENT AND TRADEMARK OFFICE

CERTIFICATE OF CORRECTION

PATENT NO. : 7,017,280 B2
APPLICATION NO. : 10/608617
DATED : March 28, 2006
INVENTOR(S) : Green et al.

It is certified that error appears in the above-identified patent and that said Letters Patent is hereby corrected as shown below:

Column 7, line 46, delete “claim 1, wherein” and insert therefor -- claim 1 wherein --.

Column 10, line 16, delete “beater element” and insert therefor -- heater element --.

Signed and Sealed this

Twenty-fourth Day of June, 2008

JON W. DUDAS
*Director of the United States Patent and Trademark Office*